US006260344B1

(12) United States Patent
Chakravarti

(10) Patent No.: US 6,260,344 B1
(45) Date of Patent: Jul. 17, 2001

(54) CUT RESISTANT ANTIMICROBIAL YARN AND APPAREL

(75) Inventor: Kalidas Chakravarti, Vermilion, OH (US)

(73) Assignee: Whizard Protective Wear Corp., Dirmingham, OH (US)

( * ) Notice: Subject to any disclaimer, the term of this patent is extended or adjusted under 35 U.S.C. 154(b) by 0 days.

(21) Appl. No.: 09/349,267

(22) Filed: Jul. 7, 1999

Related U.S. Application Data

(63) Continuation-in-part of application No. 09/225,295, filed on Jan. 8, 1998.

(51) Int. Cl.[7] ..... D02G 3/06
(52) U.S. Cl. ..... 57/230; 57/210
(58) Field of Search ..... 57/210, 230; 2/2.5, 2/167; 442/203; 428/222; 424/404, 409

(56) References Cited

U.S. PATENT DOCUMENTS

| | | | | |
|---|---|---|---|---|
| 2,942,442 | | 6/1960 | Michael-Lohn . | |
| 3,739,400 | | 6/1973 | Colehower . | |
| 4,128,529 | | 12/1978 | Becker et al. . | |
| 4,470,251 | | 9/1984 | Bettcher . | |
| 4,528,223 | | 7/1985 | Kumazawa . | |
| 4,651,514 | * | 3/1987 | Collett | 2/167 |
| 4,777,789 | | 10/1988 | Kolmes et al. . | |
| 4,838,017 | * | 6/1989 | Kolmes et al. | 57/210 |
| 4,842,932 | * | 6/1989 | Burton | 428/375 |
| 4,864,852 | | 9/1989 | Booone . | |
| 4,912,781 | | 4/1990 | Robins et al. . | |
| 4,936,085 | | 6/1990 | Kolmes et al. . | |
| 5,070,540 | | 12/1991 | Bettcher et al. . | |
| 5,119,512 | | 6/1992 | Dunbar et al. . | |
| 5,135,811 | * | 8/1992 | White et al. | 428/375 |
| 5,177,948 | * | 1/1993 | Kolmes et al. | 57/230 |
| 5,321,960 | | 6/1994 | Whit et al. . | |
| 5,568,657 | | 10/1996 | Cordova et al. . | |
| 5,597,649 | | 1/1997 | Sandor et al. . | |
| 5,628,172 | | 5/1997 | Kolmes et al. . | |
| 5,686,096 | | 11/1997 | Khan et al. . | |
| 5,721,179 | | 2/1998 | Shi et al. . | |
| 5,822,791 | | 10/1998 | Baris . | |
| 5,845,476 | | 12/1998 | Kolmes . | |
| 5,856,005 | * | 1/1999 | Gurian | 428/370 |
| 5,919,554 | | 7/1999 | Watterson, III et al. . | |
| 5,965,223 | | 10/1999 | Andrews et al. . | |
| 5,968,207 | * | 10/1999 | Li | 8/490 |

FOREIGN PATENT DOCUMENTS

| | | |
|---|---|---|
| 53-45443 | 4/1978 | (JP) . |
| 60-209038 | 10/1985 | (JP) . |
| 9935315 | 7/1999 | (WO) . |

* cited by examiner

*Primary Examiner*—John J. Calvert
*Assistant Examiner*—Gary L. Welch
(74) *Attorney, Agent, or Firm*—Watts, Hoffmann, Fisher & Heinke Co.

(57) ABSTRACT

A knittable cut resistant yarn for use in protective wear, such as gloves, arm protectors, aprons, or the like, including a core with at least one strand of flexible material selected from the group consisting of stainless steel wire and poly-paraphenylene terephthalamide. The core is wrapped with at least one strand of an antimicrobial treated acrylic fiber. A first wrap is wound in one direction about the core having a denier in the range of about 75 to about 600. Each additional wrap is wound about the core in a different direction. The antimicrobial treated acrylic fiber contains the antimicrobial agent 5-chloro-2-(2,4-dichlorophenoxy)phenol.

20 Claims, 1 Drawing Sheet

CUT RESISTANT ANTIMICROBIAL YARN AND APPAREL

CROSS-REFERENCE TO RELATED APPLICATION

This application is a Continuation-in-part application of, and claims priority from, U.S. patent application Ser. No. 09/225,295 entitled "Cut Resistant Yarn and Apparel" filed on Jan. 8, 1998, hereby incorporated by reference in its entirety.

TECHNICAL FIELD

This invention relates to a cut-resistant yarn and apparel made therefrom, specifically a protective glove.

DISCLOSURE OF THE INVENTION

The present invention provides a new and improved yarn that provides both cut-resistance and protection against bacteria that can reside in gloves, especially when used in various food handling industries, and result in an unsanitary condition, or improper washing after using the gloves. The new and improved yarn provides apparel with a softer feel and improved flexibility that is more comfortable to use.

A preferred yarn is suitable in diameter for machine knitting and is flexible enough to be used for making protective gloves. Preferably the yarn is of composite construction utilizing synthetic fibers and cut resistant core material. At least one of the fibers is an acrylic and is coated or impregnated with an antimicrobial chemical.

In its broad aspects, the yarn is comprised of a acrylic fiber strand that contains an anti-microbial chemical and a strand of cut-resistant material and is of a total denier and diameter suitable to be knit on a commercial knitting machine.

In a preferred embodiment for this invention, the knittable cut-resistant yarn comprises a core having at least one strand of a multi filament, cut resistant poly-paraphenylene terephthalamide having a total denier in the range of about 200 to 600 and preferably a denier of about 400 or a stainless steel wire having a diameter in the range of 0.001–0.004 inch and preferably a diameter of substantially 0.002 inches. Poly-paraphenylene terephthalamide, also known as para-aramid, is sold under the trade name KEVLAR. The poly-paraphenylene terephthalamide chains are highly oriented with strong interchain bonding which result in a unique combination of properties, including among others, superior cut resistance. In addition to the use of KEVLAR strands or stainless steel wires, the core may also include other flexible materials, such as fiberglass having a denier in a range of about 100 to about 400. The core strands are substantially parallel and are wrapped by a plurality of synthetic fibers to a final diameter suitable for use in a commercial knitting machine. A first wrap is wound in one direction about the core and a second wrap is wound in an opposite direction to the first wrap. Each subsequent wrap is wound in a direction opposite to the previous wrap. The fibers used in the wraps have a denier in a range from about 70 to about 600. In the preferred embodiment, at least one wrap comprises an antimicrobial ring spun acrylic fiber with an effective denier range from about 200 to about 300.

The wraps are preferably wound about the core at a rate of 7–12 turns per inch. In the illustrated embodiment, the first and second wraps are wrapped at the rate of 8 turns per inch. Additional wraps can be wound about the core and the amounts necessary will be apparent to one of ordinary skill in the art in view of the intended application for the yarn.

In the preferred embodiment, the antimicrobial treated fiber is an acrylic material containing the antimicrobial chemical 5-chloro-2(2,4-dichlorobisphenoxy)phenol. The antimicrobial of this type is sold by the trade name Triclosan. Triclosan is a bisphenol derivative that has bacteriostatic activity against a wide range of gram positive and gram negative bacteria. One example of an acrylic fiber with Triclosan in the polymer fiber matrix is available from Sterling Industries and is sold under the trade name BIOFRESH. The preparation of antimicrobial fibers is known to those skilled in the art. One such procedure involves preparing the fibers having antimicrobial activity by melt spinning the fibers with the antimicrobial agent or by mixing a proper amount of antimicrobial agents in a polymer solution and thereafter spinning the mixture through spinnerates into a coagulating bath to form into fibers. It is preferred to use a fiber wherein the polymer matrix contains the antimicrobial. It has been found that antimicrobial residing on the surface of the fiber wears off during use or is washed off during cleaning of the apparel with soap and other detergents. The use of antimicrobial in the fiber'polymer matrix wherein the antimicrobial resides in the interstices of the matrix serves as a source for surface replenishment of the antimicrobial. It is believed that the antimicrobial filled interstices act as a reservoir from which the antimicrobial can bloom to the surface after a period of time so that antimicrobial that had been worn or washed off the surface is replaced. Thus, it has been found that an effective amount of antimicrobial is present after repetitive use or washing thereby prolonging the use of the glove.

In the illustrated embodiment the core also includes at least one strand of a high strength, cut-resistant fiberglass fiber having a denier in the range of 75–500 and preferably has a denier of about 300.

The yarn described above can be used to make protective gloves of the type that are used in the food handling industry. It has been found that the gloves made according to the invention are softer and more flexible than other gloves of this type and are still capable of dealing with bacteria that comes in contact with the glove. Moreover, the use of acrylic fibers in combination with other polymeric materials, such as but not limited to, KEVLAR, high density polyethylene and fiberglass or stainless steel, results in a cut and bacteria resistant glove that is softer and more comfortable to use with unexpectedly improved gripping power. In the preferred construction, the antimicrobial treated acrylic fiber is used as wraps rather than a core of the composite yarn. The antimicrobial acrylic fibers have good strength and durability to comprise all of the wrap layers or are located in the intermediate wrap layers of the yarn composite. Other polymeric synthetic fibers such as nylon, polyester or high density polyethylene can also be used in addition to the antimicrobial treated acrylic fibers. The antimicrobial treated acrylic fibers are relatively expensive compared to untreated fibers and as such, it is preferred that the amounts of antimicrobial treated acrylic fibers in a yarn composite range from about 15% to about 50% of the total yarn weight. Higher amounts can be used but the use of higher amounts is not cost effective. More preferably, the amount of antimicrobial used in the yarn composite is about 20% of the total yarn weight. Each fiber preferably comprises 0.5% to 2.0% antimicrobial agent Triclosan of the total weight of the fiber. The amounts used for other antimicrobial agents in fibers will vary depending on the properties of the agent and will be apparent to those skilled in the art.

The use of acrylic fibers for knitting gloves result in a softer and more comfortable fitting glove. Furthermore, it has been found that gloves made from these yarn composites exhibit good durability and demonstrate improved gripping power over prior art gloves.

It is believed that by using the antimicrobial treated spun acrylic fiber as wraps instead of as a core provides a softer glove with improved gripping ability. If the yarn, for example, is used to make a glove used in the food handling and processing industry, bacteria is transmitted to the glove when the outside of the glove makes contact with fluids and solutions encountered in processing or handling food, such as meat. As a result of capillary action, these fluids migrate quickly towards the center of the yarn. The bacteria is carried towards the center of the yarn with fluid. Once the bacteria makes contact with the anti-microbial treated fiber, its growth and propagation is inhibited. General washing of the gloves after use is recommended for removal of all contaminants. With the preferred construction, washing the glove with appropriate detergent and water will remove most of the bacterial contamination from the surface of the glove, and the core of the glove will also be free of bacteria due to the presence of the antimicrobial agent in close proximity to the core material.

Other embodiments of the invention are contemplated to provide particular features and structural variants of the basic elements. The specific embodiments referred to as well as possible variations and the various features and advantages of the invention will become better understood when considered in connection with the accompanying drawings and the detailed description that follows.

BEST MODE FOR CARRYING OUT THE INVENTION

Figure 1:
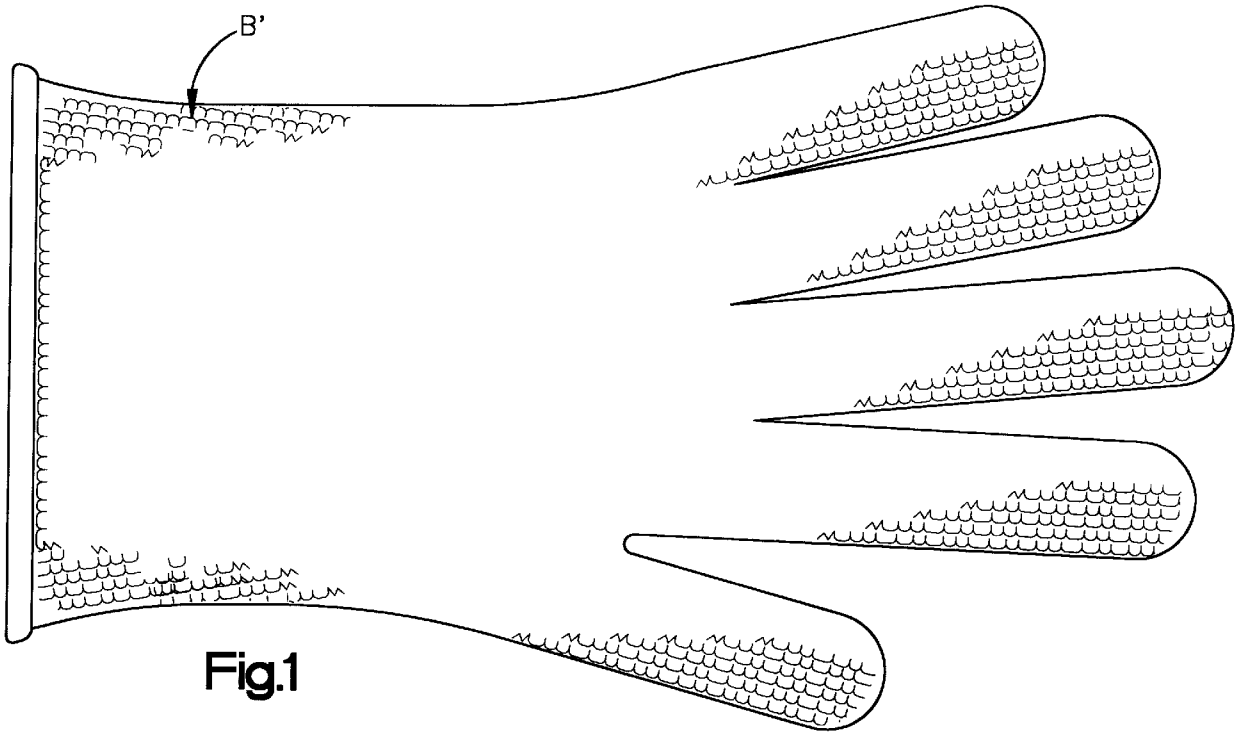
FIG. 1 is a diagrammatic plan view of a protective glove, embodying the present invention; and, FIG. 2 is a diagrammatic drawing of a composite yarn constructed in accordance with the invention.
Figure 2:
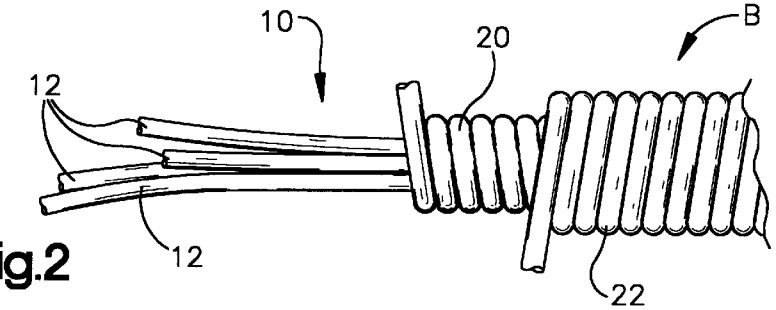

A preferred embodiment of a yarn B of this invention is shown in FIG. 2 of the appended drawings and is suitable for machine knitting a protective glove B' shown in FIG. 1. The yarn B has a central core 10 comprised of a plurality of parallel strands 12. The strands include at least one strand of 400 denier KEVLAR fiber and/or one strand of annealed stainless steel wire having a diameter of 0.002 inches. Optionally, other strands (not shown) such as glass fibers are used which are also cut-resistant and shrink-resistant, such as fiberglass strands. The core strands are substantially parallel. The yarn as shown in FIG. 2 has two wrappings, 20, and 22, each preferably wound in an opposite direction from the other, eight turns per inch, with each turn substantially touching the next to substantially cover the core. Preferably, at least one wrapping is the antimicrobial ring spun acrylic fiber. Although not shown, numerous subsequent wrappings can be included and would be preferably wound in an opposite direction to the previous wrap. The amount of wrappings will be dependent on the intended application for the yarn.

If a colored glove is desired, the outer wrappings comprise strands of a solution dyed polyester or nylon and provide an overall coloring to the glove. It has been found that the use of the dyed polyester gives a pleasing color to the glove when overall coloring is desired. The denier of the colored wrapping fiber may vary between 70 and 840. Nylon may be substituted for polyester fiber used in the wraps (not shown). The denier range for nylon is 75–840.

Antimicrobial acrylic fibers are used because of the softness imparted to the apparel. While BIOFRESH, made by Sterling Industries is used in the preferred embodiment, other sources or other products containing an antimicrobial can be used. Preferably, the core strands constitute about 20 to 50% by weight of the total yarn. More preferably, the core strands constitute about 40% of the total yarn. It is contemplated that the acrylic strand or strands containing antimicrobial chemical may constitute up to about 50% by weight of the total yarn.

EXAMPLE 1

A glove of the type used in the food industry is knit from a composition of an inventive yarn using antimicrobial acrylic fibers in the wraps about the core. The composition of the yarn is shown in Table I and is suitable for use in commercial knitting machines. The core material is substantially parallel and is comprised of one strand of 400 denier KEVLAR and one strand of 300 denier fiberglass ECG 150. A first wrap is wound about the core fibers in a first direction. A second wrap is wound about the core in an opposite direction to the first wrap. The first and second wrap materials comprise acrylics fibers containing an antimicrobial agent and sold under the trade name BIOFRESH. A third wrap is wound in an opposite direction to the second wrap about the core and is comprised of 210 denier high density polyethylene fiber sold under the trade name SPECTRA by Allied Signal. A fourth wrap is wound in an opposite direction to the third wrap about the core and is comprised of 200 denier textured polyester. Each wrap about the core is at 8 wraps per inch. The percentages of each material used for the composite yarn are shown in Table I. The yarn is prepared according to methods known to those skilled in the art.

TABLE I

A yarn composite suitable for use in glove construction is as follows.

| | Material | Denier | WPI | % Comp. |
|---|---|---|---|---|
| Core | KEVLAR | 400 | — | 23.0 |
| | Fiberglass (type BCG 150) | 150 | — | 19.0 |
| 2st Wrap | BIOFRESH acrylic | 300 | 8 | 16.6 |
| 2nd Wrap | BIOFRESH acrylic | 300 | 8 | 15.0 |
| 3rd Wrap | SPECTRA polyethylene | 210 | 8 | 13.4 |
| 4th Wrap | Textured polyester | 200 | 8 | 13.0 |

A 10 gauge Shima commercial knitting machine was used to make the gloves. The stitch per inch for the glove was adjusted to about 12.0. The knitted gloves made from the inventive yarn provided a softer feel and flexibility that resulted in a more comfortable glove to use compared to other gloves made with different yarns made of entirely non-acrylic materials. The I.T.F. (Institute Textile du France) cut resistance was greater than level 3 indicating that cut resistance was very good. The ASTM (method # F-1790-97) cut test was about 2000 gm. Gripping power for this glove was observed to be superior to a standard polyester/KEVLAR glove made without acrylic fibers. It is believed that the improved gripping power results from the use of the acrylic fiber with textured polyester.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A knittable cut-resistant yarn for use in protective wear, such as gloves, arm protectors, and aprons, comprising:

a) a core having at least one strand of flexible material selected from the group consisting of a stainless steel, a fiberglass and a poly-paraphenylene terephthalamide;

b) a first wrap wound in one direction about the core comprising a strand of an anti-microbial treated acrylic fiber, said first wrap having a denier in a range of about 75 to about 600; and, c) at least one additional wrap wherein each said additional wrap is wound in a different direction about said core having a denier in the range of about 75 to about 600.

2. The yarn of claim 1, wherein said stainless steel material has a diameter of about 0.002 inches.

3. The yarn of claim 2, wherein each said additional wrap has a denier of substantially 300.

4. The yarn of claim 1, wherein said poly-paraphenylene terephthalamide material has a denier in a range of about 200 to 600.

5. The yarn of claim 1, wherein said first wrap has a denier of substantially 300.

6. The yarn of claim 1, wherein said first wrap and said additional wraps are wrapped at a rate of 7–12 wraps per inch about said core.

7. The yarn of claim 1, wherein said anti-microbial treated acrylic fiber contains 5 chloro-2-(2,4 dichlorophenoxy) phenol.

8. The yarn of claim 1, wherein said core further comprises at least one fiberglass fiber.

9. The yarn of claim 8, wherein said fiberglass fiber has a denier in a range of about 75 to about 500.

10. The yarn of claim 1, wherein the said additional wrap is selected from the group consisting of a high density polyethylene and a polyester having a denier in the range of 75 to 600.

11. The yarn of claim 10, wherein said additional wrap has a denier in the range of 200 to 400.

12. The yarn of claim 1, wherein said core is from about 20 to 50% by weight of the total yarn.

13. The yarn of claim 1, wherein said core is about 40 percent by weight of the total yarn.

14. A cut-resistant knittable yarn for making fabric adapted to be used with protective wear, such as gloves, arm protectors, and aprons, comprising:

a) a core including at least two longitudinally extending synthetic fibers;

b) at least one inner wrap wound around said core made from a synthetic fiber;

c) an outer wrap wound around said at least one inner wrap; and d) an inner fiber comprising an anti-microbial treated acrylic fiber.

15. The yarn of claim 14, wherein said acrylic fiber contains an anti-microbial agent forming part of the matrix of the polymer.

16. The yarn of claim 15 wherein said antimicrobial is 5-chloro-2-(2,4-dichlorophenoxy)phenol.

17. A knittable cut-resistant yarn for use in protective wear, such as gloves, arm protectors, and aprons, comprising:

a) a core having at least one strand of flexible material selected from the group consisting of a stainless steel, a fiberglass and a poly-paraphenylene terephthalamide;

b) a plurality of inner wraps wound about the core, wherein said inner wraps are wound in a different direction than the previous inner wrap and at least one of said inner wraps comprises an anti-microbial treated acrylic fiber having a denier in a range of about 75 to about 600; and, c) an outer wrap around said plurality of inner wraps.

18. The yarn of claim 17, wherein said core further comprises at least one fiberglass fiber.

19. A knittable cut-resistant yarn for use in protective wear, such as gloves, arm protectors, and aprons, comprising:

a) a core having at least one strand of flexible material selected from the group consisting of a stainless steel, a fiberglass and a poly-paraphenylene terephthalamide;

b) a first wrap wound about the core comprising a strand of an anti-microbial treated acrylic fiber, said first wrap having a denier in a range of about 75 to about 600; and, c) at least one additional wrap wound about said core having a denier in the range of about 75 to about 600.

20. The knittable cut-resistant yarn of claim 19 wherein said additional wrap is wound about the core in a different direction from said first wrap.

* * * * *